US010505307B2

(12) United States Patent
Shah et al.

(10) Patent No.: US 10,505,307 B2
(45) Date of Patent: Dec. 10, 2019

(54) PLASTIC-LINED INTERCONNECT RECEPTACLE

(71) Applicant: Microsoft Technology Licensing, LLC, Redmond, WA (US)

(72) Inventors: Akash Atul Shah, Seattle, WA (US); Kurt David Wrisley, Edmonds, WA (US); Hua Wang, Sammamish, WA (US); Guido Gruesshaber, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 11 days.

(21) Appl. No.: 15/605,850

(22) Filed: May 25, 2017

(65) Prior Publication Data

US 2018/0287288 A1 Oct. 4, 2018

Related U.S. Application Data

(60) Provisional application No. 62/479,215, filed on Mar. 30, 2017.

(51) Int. Cl.
*H01R 13/504* (2006.01)
*H01R 107/00* (2006.01)
(Continued)

(52) U.S. Cl.
CPC ..... *H01R 13/504* (2013.01); *H01R 13/6594* (2013.01); *H01R 24/60* (2013.01);
(Continued)

(58) Field of Classification Search
CPC ..... H01R 13/465; H01R 13/50; H01R 24/64; H01R 43/205; H01R 2107/00;
(Continued)

(56) References Cited

U.S. PATENT DOCUMENTS 5,295,872 A * 3/1994 Christensson ..... A61N 1/048 439/822
5,928,035 A * 7/1999 Jankowsky ..... H01R 12/707 439/607.36

(Continued)

FOREIGN PATENT DOCUMENTS

CN 203574963 U 4/2014

OTHER PUBLICATIONS

"GTcoupe High Speed Gold Plated USB Type-C to USB Charge Cable (1m)", http://www.dx.com/p/gtcoupe-high-speed-gold-plated-usb-type-c-to-usb-charge-cable-1m-457049, Published on: 2006, 8 pages.

(Continued)

*Primary Examiner* — Travis S Chambers
(74) *Attorney, Agent, or Firm* — Alleman Hall Creasman & Tufte LLP

(57) ABSTRACT

Provided is a plastic-lined interconnect receptacle configured to receive a plug therein. The interconnect receptacle may include a tongue with pins applied thereon for electrical contact with the plug, a metal shell comprising a plurality of inner walls configured to surround at least a portion of the tongue, and a plastic liner positioned inside the metal shell to cover at least three of the inner walls. With such an interconnect receptacle, a color of the plastic liner may be an external color of a computing device in which the interconnect receptacle is installed while maintaining compliance with a UNIVERSAL SERIAL BUS or DISPLAYPORT specification.

21 Claims, 12 Drawing Sheets

(51) Int. Cl.
*H01R 43/20* (2006.01)
*H01R 13/6594* (2011.01)
*H01R 24/60* (2011.01)

(52) U.S. Cl.
CPC ..... *H01R 43/205* (2013.01); *H01R 2107/00* (2013.01); *H01R 2201/06* (2013.01)

(58) Field of Classification Search
CPC ..... H01R 2201/06; H01R 13/6593; H01R 13/504; H01R 24/60; H01R 13/6587; H01R 13/6594; B29C 45/0025; B29C 45/0046
USPC ... 439/488, 607.55, 695, 724, 607.35, 607.4
See application file for complete search history.

(56) References Cited

U.S. PATENT DOCUMENTS 7,799,991 B1 * 9/2010 Advey ..... H01R 13/5213 174/50
8,133,078 B2 * 3/2012 Lin ..... H01R 12/712 439/218
8,628,346 B2 * 1/2014 Gao ..... H01R 13/741 439/357
8,827,129 B2 9/2014 Youssefi-Shams et al.
9,502,838 B2 * 11/2016 Lin ..... H01R 13/506
2008/0001405 A1 1/2008 Gey
2011/0124226 A1 * 5/2011 Xiao ..... H01R 13/648 439/607.55
2013/0189880 A1 * 7/2013 Wang ..... H01R 13/7031 439/660
2014/0295694 A1 * 10/2014 Ludwig ..... H01R 13/5841 439/452
2015/0200472 A1 * 7/2015 Hsu ..... H01R 12/58 439/83
2015/0207264 A1 * 7/2015 Arai ..... H01R 13/405 439/660
2015/0244111 A1 * 8/2015 Ju ..... H01R 13/6585 439/607.05
2017/0017268 A1 1/2017 Guerdrum et al.

OTHER PUBLICATIONS

"Pureflex Plastic-Lined Hoses: Rubber & Flexible Metal Hoses", http://www.corrosionfluid.com/pureflex-lined-hoses-fittings-liners-ptfe-pfa-fep-pvdf-polypropylene-flexible-metal-rubber.aspx, Retrieved on: Mar. 20, 2017, 9 pages.

* cited by examiner

PLASTIC-LINED INTERCONNECT RECEPTACLE

CROSS REFERENCE TO RELATED APPLICATIONS

This application claims priority to U.S. Provisional Patent Application No. 62/479,215 filed Mar. 30, 2017, the entirety of which is hereby incorporated herein by reference.

BACKGROUND

Interconnect receptacles for receiving plugs of a corresponding type are commonly installed in a variety of computing devices such as personal computers, laptops, tablets, smartphones, televisions, etc. Many of these are made in compliance with a corresponding standard such a UNIVERSAL SERIAL BUS (USB), DISPLAYPORT, or HIGH-DEFINITION MULTIMEDIA INTERFACE (HDMI) specification which limits properties such as physical dimensions, electrical shielding, and various durability test results so that a corresponding standard plug can be used in conjunction with any manufacturer's receptacle and result in a consistent experience for the user. As a result, substantially altering the materials and components of a receptacle while maintaining compliance with the corresponding standard can be difficult.

In recent years, a wide variety of computing devices have been manufactured with colored external surfaces other than a typical metallic color such as silver or gold. However, due to requirements such as electrical or radio shielding set by the corresponding standard, interconnect receptacles installed in a colored computing device generally remain metal with at most a metallic finish or plating applied to visible surfaces such as an inner surface and outer rim. Particularly in high-end devices, this mismatch of colors can lead to unsightly clashing to a discerning user, or else limit the color options of the computing device to metallic colors such as silver or black, in order to have a consistent appearance that is customizable and cosmetically pleasing for the user.

SUMMARY

Provided is a plastic-lined interconnect receptacle configured to receive a plug therein. The interconnect receptacle may include a tongue with pins applied thereon for electrical contact with the plug, a metal shell comprising a plurality of inner walls configured to surround at least a portion of the tongue, and a plastic liner positioned inside the metal shell to cover at least three of the inner walls. With such an interconnect receptacle, a color of the plastic liner may be an external color of a computing device in which the interconnect receptacle is installed while maintaining compliance with a specification such as UNIVERSAL SERIAL BUS or DISPLAYPORT.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
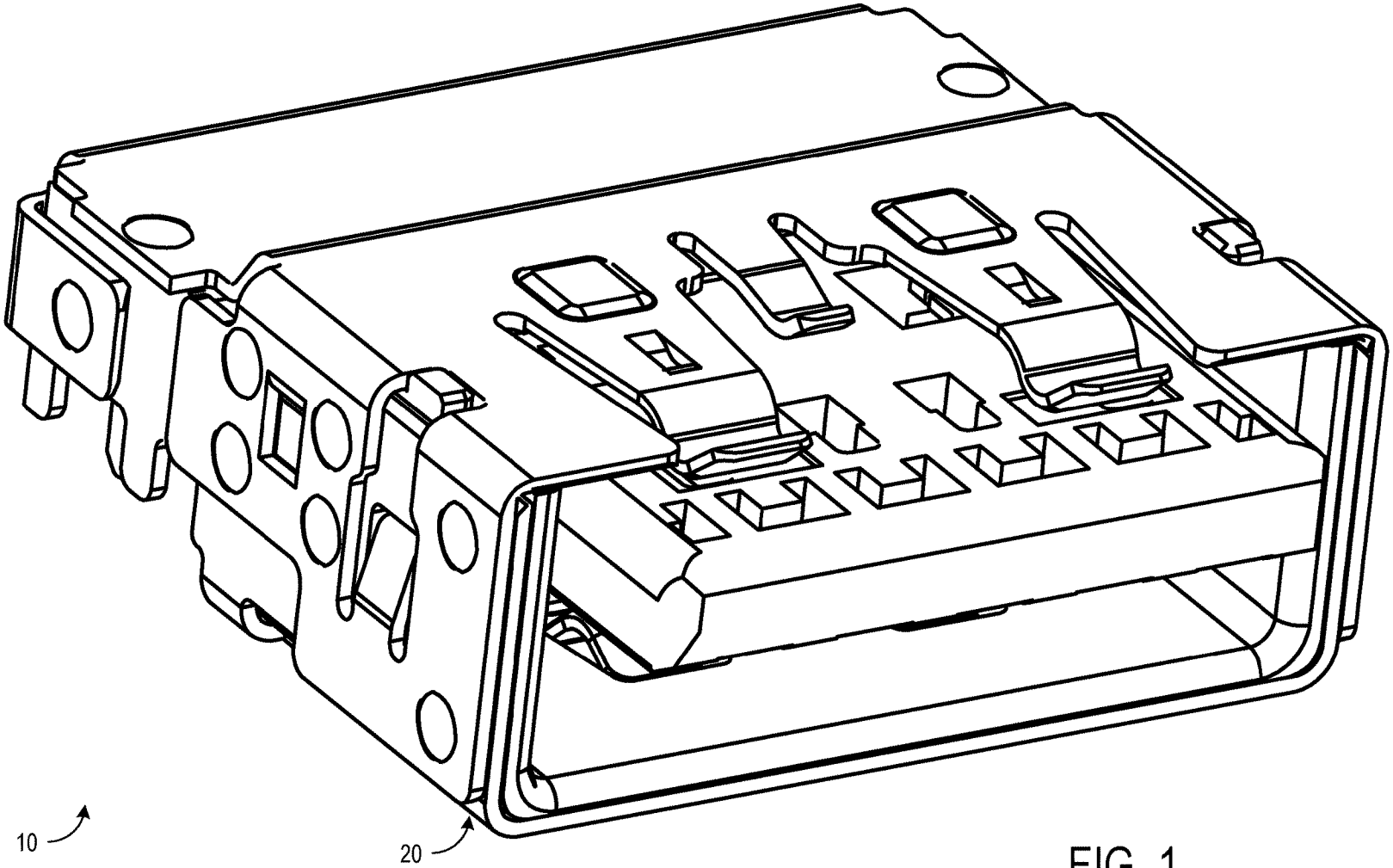
FIG. 1 shows a perspective view of a first type of interconnect receptacle.
Figure 2:
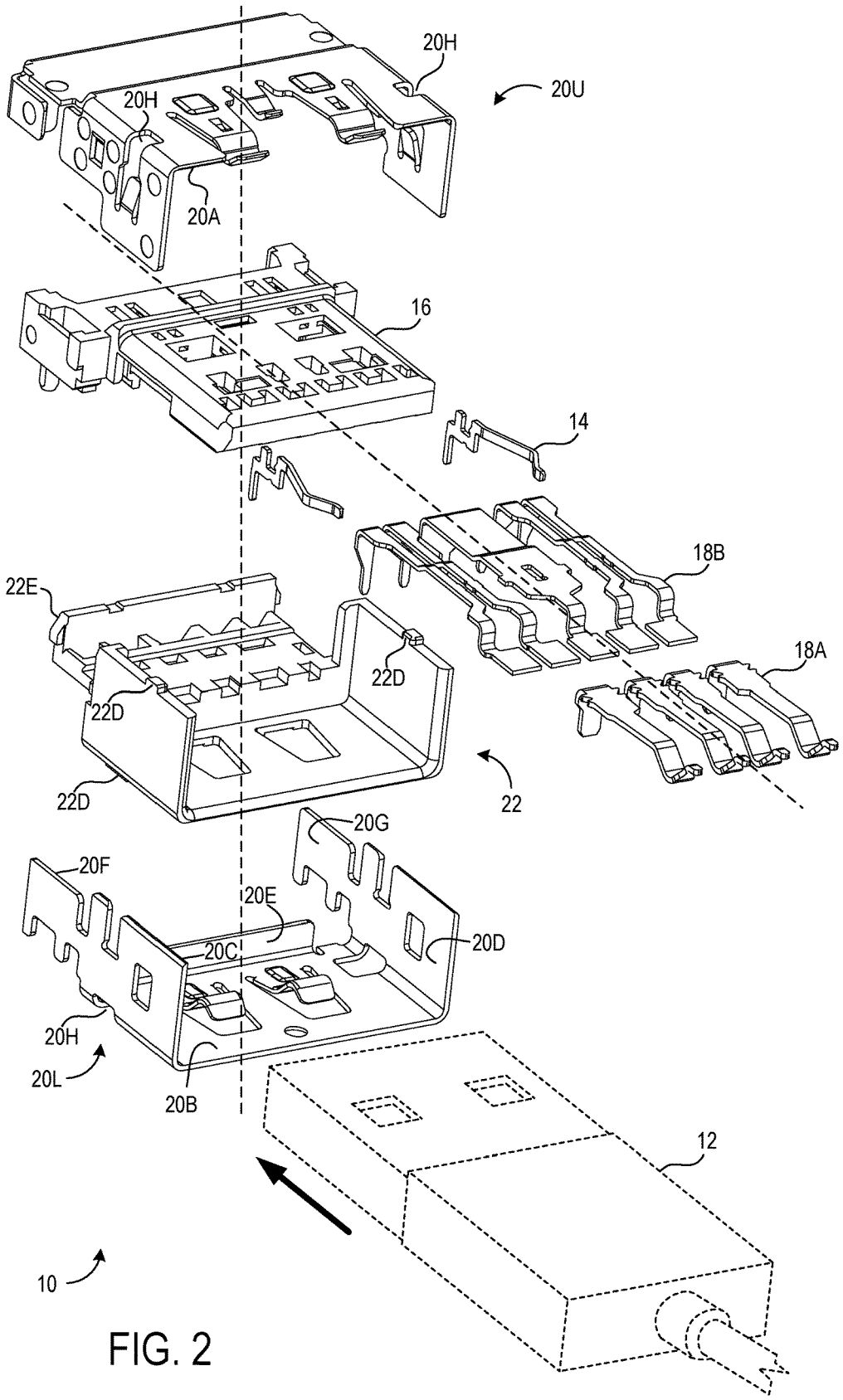
FIG. 2 shows an exploded view of the first type of interconnect receptacle.

FIG. 1 shows a perspective view of a first type of interconnect receptacle. The example receptacles and components thereof shown in FIGS. 1-10C are substantially to scale, although it will be appreciated that minor variations may be made without departing from the scope of the claimed subject matter. In this example, an interconnect receptacle 10 is depicted as a UNIVERSAL SERIAL BUS (USB) TYPE-A receptacle, also referred to as a USB-A connector, and therefore may be compliant with a USB specification such as USB 1.x, 2.0, 3.0, and/or 3.1. It will be appreciated that as new specifications are written, the components of the receptacle 10 may be adapted in future products to remain compliant with any given specification version. FIG. 2 shows an exploded view of the first type of interconnect receptacle. The interconnect receptacle 10 may be configured to receive a plug 12 therein, and the plug 12 may be of a corresponding type, e.g., a USB-A plug in this example. The plug 12 may be connected to a peripheral device, with or without an intervening cable, and may facilitate power and/or data transfer between the peripheral device and a computing device or power source to which the receptacle 10 is connected. The plug 12 may also be used to connect two computing devices to each other. The receptacle 10 may further include electromagnetic interference (EMI)/retention spring fingers 14 to stabilize and detect insertion of the plug 12.

The receptacle 10 may comprise a tongue 16 with pins 18A, 18B applied thereon for electrical contact with the plug 12. In this example, the pins 18A may be USB 2.0 pins for transfer according to USB 2.0/1.x and the pins 18B may be USB 3.0 pins for transfer according to USB 3.0/3.1. It will be appreciated that portions of the pins 18A, 18B may be embedded within the tongue 16 and portions may be positioned on a surface thereof. The receptacle 10 may be in a horizontal mounting position, with the tongue 16 extending horizontally. The receptacle 10 may further include a metal shell 20 (see FIG. 1) comprising a plurality of inner walls, e.g., inner walls 20A-20D, configured to surround at least a portion of the tongue 16. The entire tongue 16 may be surrounded by the shell 20, or a small portion of the tongue 16 may protrude out the front or rear openings of the shell 20 in some configurations. The tongue 16 may be considered to be circumferentially surrounded by the shell 20 (e.g., surrounded on a top, bottom, and two sides, but not on a front or rear surface), and in some cases, may further surround the tongue 16 over a rear surface thereof. The plurality of inner walls, e.g., inner walls 20A-20D, of the metal shell 20 may include a top 20A, a bottom 20B, and two sides 20C, 20D. The metal shell 20 may further include a rear wall 20E, and rear side walls 20F, 20G. In addition, some of the inner walls 20A-20G may be shorter than the tongue 16 in a given dimension even though other walls may cover the tongue 16, and as shown with the inclusion of rear side walls 20F, 20G, some inner walls may also be longer than the tongue 16. The metal shell 20 may include joined upper and lower shells 20U, 20L. A rear surface of the upper shell 20U may be covered by the tongue 16. The inner walls 20A-20D may together form a complete circumference around the tongue 16 with an intervening gap, but may also include various cutouts, grounding springs, slots, and tabs such that the inner walls 20A-20G are not smooth, continuous surfaces.

Figure 3:
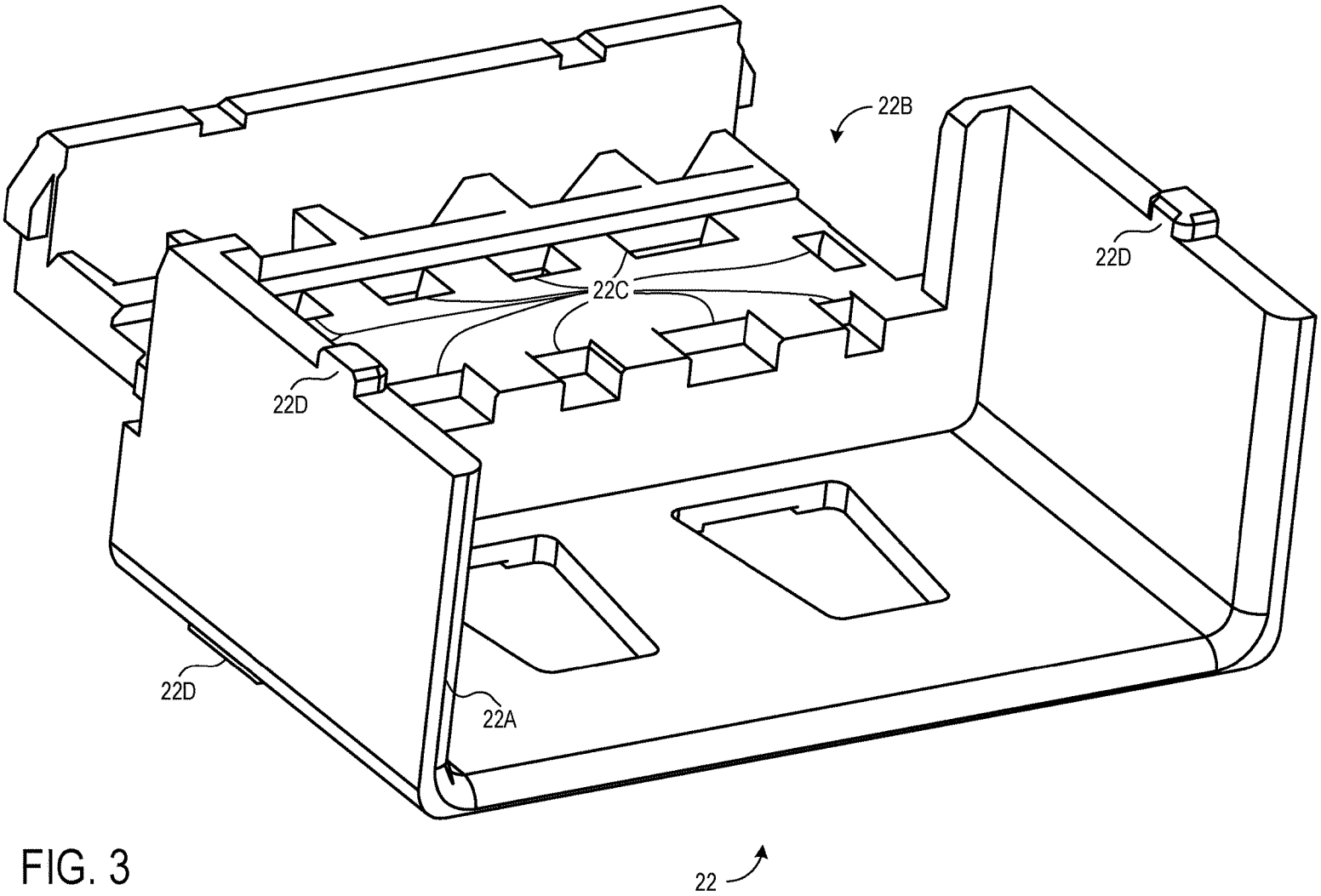
FIG. 3 shows a perspective view of a liner of the first type of interconnect receptacle.

The receptacle 10 may further include a plastic liner 22 positioned inside the metal shell 20 to cover at least three of the inner walls 20A-20D. An enlarged view of just the liner 22 is shown in FIG. 3. The plastic liner 22 may cover the two sides 20C, 20D and at least one of the top 20A and the bottom 20B of the shell 20, in this example, the bottom 20B. The tongue 16 of the USB-A receptacle 10 may be so close to the top 20A as to obscure it from view, and thus the liner 22 may not be formed with a top side in this case, resulting in a U-shaped front portion of the liner 22. The liner 22 may further cover the rear wall 20E of the shell 20 with a rear wall 22E, and may be adapted to cover the rear side walls 20F, 20G as well; however, as the rear side walls 20F, 20G are not visible to a user when the receptacle 10 is assembled and installed, manufacturing of the receptacle 10 may be simplified by leaving these walls bare. Furthermore, the plastic liner 22 and the tongue 16 may be separately formed of the same material of the same color. In this manner, the visible surfaces of the open receptacle 10 can be made substantially uniform, allowing for a high quality cosmetic effect. Small portions of metal parts such as spring fingers and pins may still be visible from the front of the receptacle 10, but the overall cosmetic effect the liner 22 provides is an improvement over the conventional bare or plated metal surfaces.

In addition, the plastic liner 22 may extend a full length of an interior of the metal shell 20, where "length" is used to mean the dimension along which the plug 12 is inserted via the entrance. As can be seen in FIG. 1, the front edges 22A of the liner 22 and the shell 20 are substantially aligned, and as can be seen from FIG. 2, the liner 22 extends approximately the same length as the interior of the shell 20. Accordingly, when the user looks through the entrance of the fully assembled receptacle 10, the metal shell 20 is substantially covered by the liner 22. Extending less than substantially the full length may expose metal to the user's view, and extending substantially beyond the full length may create a leak area for radio frequency (RF) noise. Further, a rear portion 22B of the liner 22 may provide function beyond cosmetics, for example, by providing additional alignment and centering features for the pins 18A, 18B and the EMI spring fingers 14 in holes 22C. Cutouts in the liner 22 may be formed to correspond to cutouts in the shell 20, for example, for retaining springs or grounding springs. When manufacturing the receptacle 10, the plastic liner 22 may be injection molded. For large cutouts, to avoid disrupting the structural integrity of the liner 22 and to minimize cosmetic impact, the cutouts around these springs may be formed in a trapezoidal shape. The narrowing tops of the cutouts may allow for liquid plastic to maintain speed when injected from the wider base side of the trapezoids, between two cutouts, as the plastic would otherwise cool and slow down toward the tops, resulting in a weak and uneven layer. Further, this injection point avoids creating a weld line between the cutouts, which may be an easily stressed weak point of the liner 22. By modeling the flow of the plastic beforehand, the injection point(s) and cutouts may be strategically placed to position the weld lines away from weak areas.

After injection molding, the plastic liner 22 may be inserted into to the metal shell 20 using interlocking parts; for example, the liner 22 may be formed with tabs 22D that fit in slots 2011 of the shell 20. The receptacle 10 may be soldered to a printed circuit (i.e., printed circuit board (PCB) or flexible printed circuit (FPC)) such as a motherboard using a reflow process which may result in a portion of the liner 22 softening and rehardening. When choosing materials for the liner 22, robustness of the liner 22 during the reflow process to solder the receptacle 10 to the PCB is one factor to be considered. The reflow process may raise temperatures to around 200-250° C. for 10 minutes, for example, depending on the materials used. The melting temperature of the material of the liner 22 therefore must allow the liner 22 to withstand such conditions if undesirable deformation is to be avoided. A liquid crystal polymer (LCP) exhibits an easy flow and can be injected at low pressure and temperature; however, areas where the injected LCP flow fronts combine to form weld lines may be notably weak, and the LCP's ability to flow at lower temperatures may result in worse deformation during reflow. Further, coloring agents may oxidize in the reflow process and fail to maintain their original and intended colors. For example, plastics colored a bright blue or red may come out of a reflow oven brown.

The plastic liner 22 may instead be formed of a material including nylon. Compared to LCP, nylon does not flow as easily as it typically requires a higher temperature and a much higher injection pressure; however, the weld lines are stronger and it also survives better (i.e., deforms less) when exposed to high temperatures. To further lower the chance and extent of deformation, the thin walls of the liner 22 may be held in place by the tabs 22D during the reflow process and thereby maintain their proper shape.

In addition, recently developed nylon polymers have a much higher color stability during both the reflow process and under ultraviolet (UV) exposure. Using such a polymer, color shifts caused by UV exposure may be tested to preemptively shift the colors used and thereby prevent degradation of the appearance of the receptacle 10 over time. In addition, using inorganic coloring agents may reduce the color shift arising from the reflow process. The color stability of the pigments may be further improved by controlling the environment of the reflow process to have very low oxygen levels, for example, no more than 1,200 ppm. The plastic liner 22 may also be formed of a fiber-reinforced plastic including glass fibers. For example, the fiber-reinforced plastic may include 10-40% glass fibers added to the abovementioned nylon. The glass fibers, when the flow is modeled to strategically set their orientation, may have the effect of increasing the strength of the plastic, allowing the liner 22 to be made as thin as possible to fit within the metal shell 20 and still meet tolerance requirements of the associated interconnect specification. When incorporating the liner 22, a net change to interference of the receptacle 10 compared to a typical unlined receptacle may be substantially zero, such that signal integrity requirements of the corresponding specification are met. Approximately 10-40% glass fibers may be sufficient to maintain compliance for the USB-A receptacle 10, with approximately 35% exhibiting better performance; however, other receptacle types may exhibit better performance with different fill percentages, as will be discussed below. In this case, since the tongue 16 and the liner 22 may be formed of the same material, approximately 35% represents a balance between the stability benefit to the liner 22 and the signal integrity detriment to the tongue 16 which holds the pins 18A, 18B.

Figure 4:
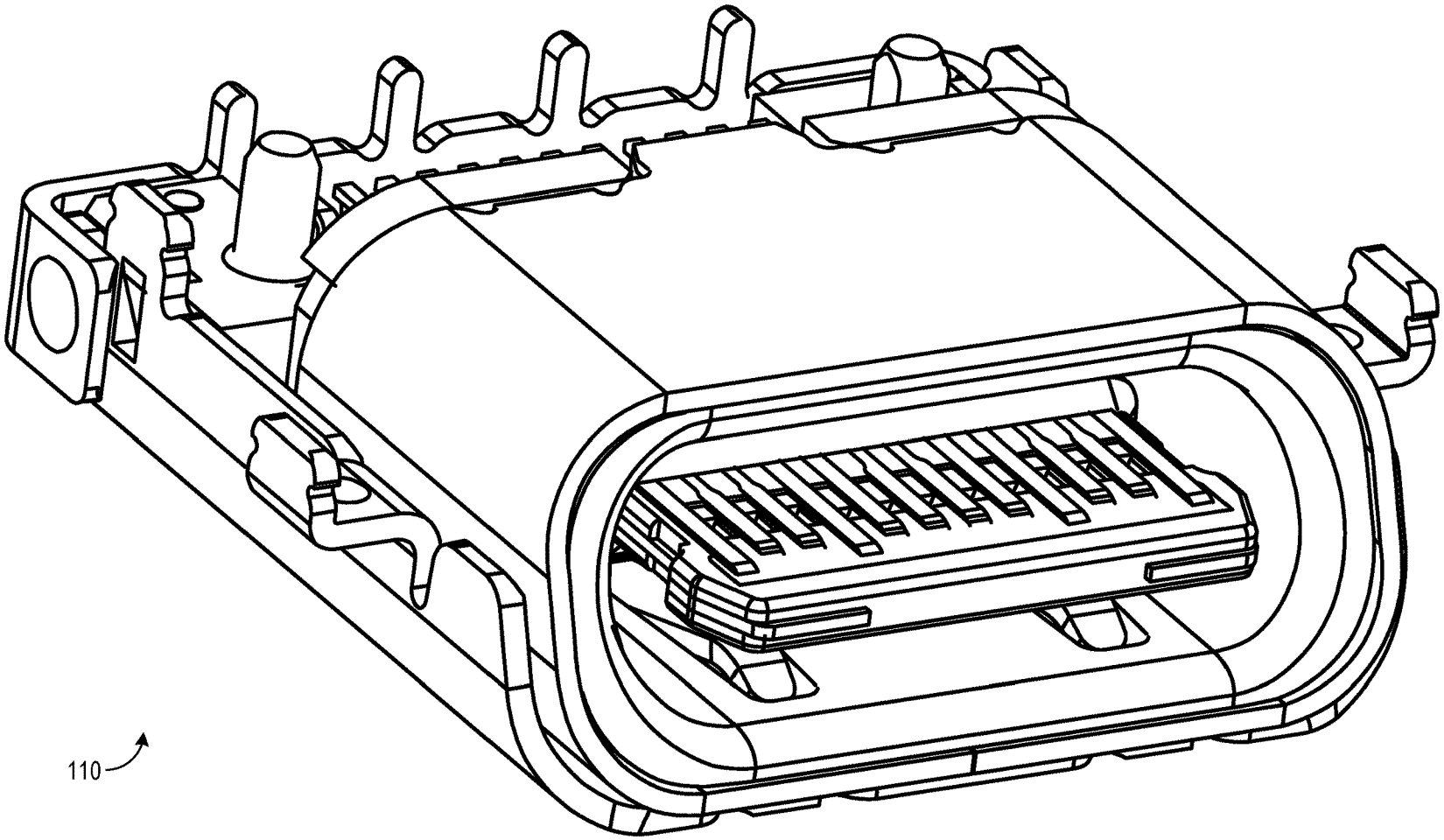
FIG. 4 shows a perspective view of a second type of interconnect receptacle.
Figure 5:
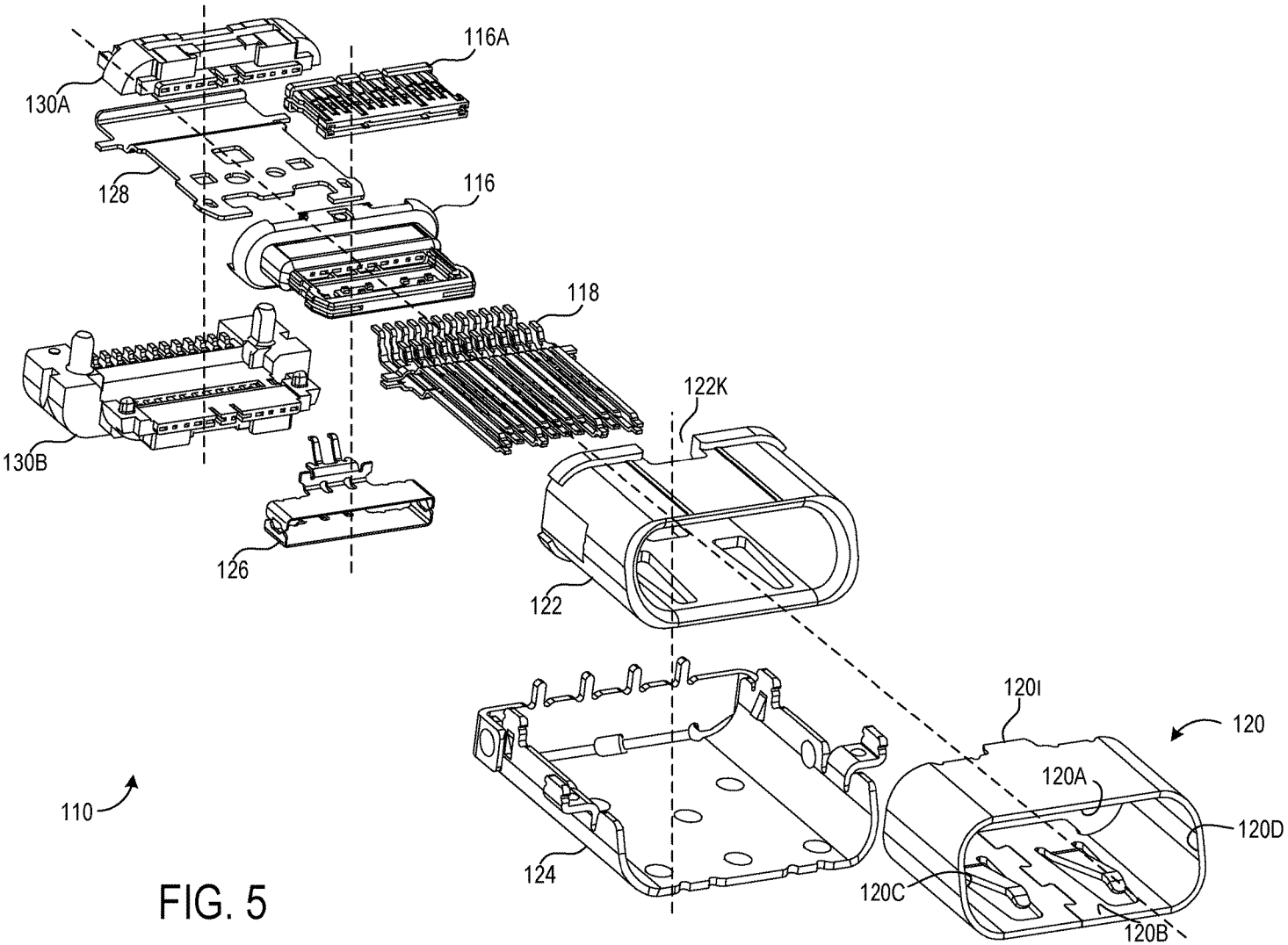
FIG. 5 shows an exploded view of the second type of interconnect receptacle.
Figure 6:
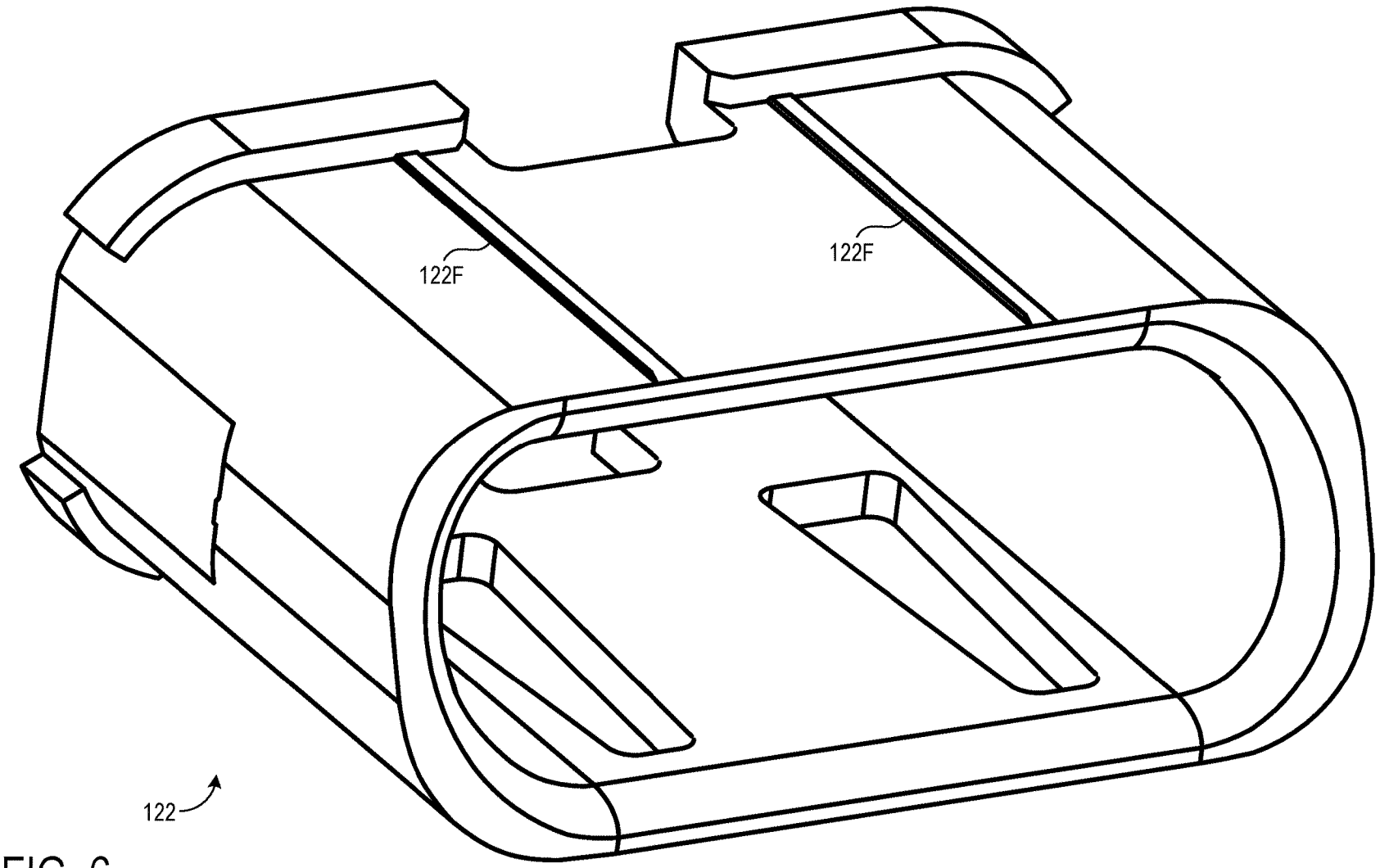
FIG. 6 shows a perspective view of a liner of the second type of interconnect receptacle.

FIG. 4 shows a perspective view of a second type of interconnect receptacle. In this example, an interconnect receptacle 110 is depicted as a USB TYPE-C receptacle, also referred to as a USB-C connector, and therefore may be compliant with a USB specification such as USB 2.0, 3.0, and/or 3.1 and TYPE-C Release 1.1 and/or 1.2. FIG. 5 shows an exploded view of the second type of interconnect receptacle. The interconnect receptacle 110 may be configured to receive the plug 12 (see FIG. 2) of a corresponding type therein, which in this example may be a USB-C plug shaped to fit the USB-C receptacle 110. When corresponding components of the USB-C receptacle 110 and the USB-A receptacle 10 are similar, repeat explanation may be brief or not provided, and differences will mainly be described instead.

The receptacle 110 may also comprise a tongue 116 with pins 118 applied thereon for electrical contact with the plug. In this example, the pins 118 may include pins for transfer according to USB 2.0, 3.0, and/or 3.1 the shell 120 may include one or more tabs 1201 to interlock with one or more slots 122K formed in the liner 122. One or more of the pins 118 may further allow transfer of data for display according to a DISPLAYPORT specification.

The plastic liner 122 may also be formed of a fiber-reinforced plastic including glass fibers. However, the USB-C receptacle 110 may be configured to run at up to THUNDERBOLT 3 speeds of 40 Gbps, which is higher than the speed of the USB-A receptacle 10 at around 5 Gbps. Higher glass fiber fill percentages may result in increased sturdiness of the plastic, which is beneficial for thin or easily stressed portions, but also may result in more interference and therefore lower signal integrity where signals are intended to pass through, for example, in the tongue 116. Therefore, to maintain an effective signal integrity while still maintaining structural stability of the liner 122, the fiber-reinforced plastic used in both the tongue 116 and the liner 122 of the receptacle 110 may include 10-25% glass fibers, with approximately 20% exhibiting better performance.

Figure 7:
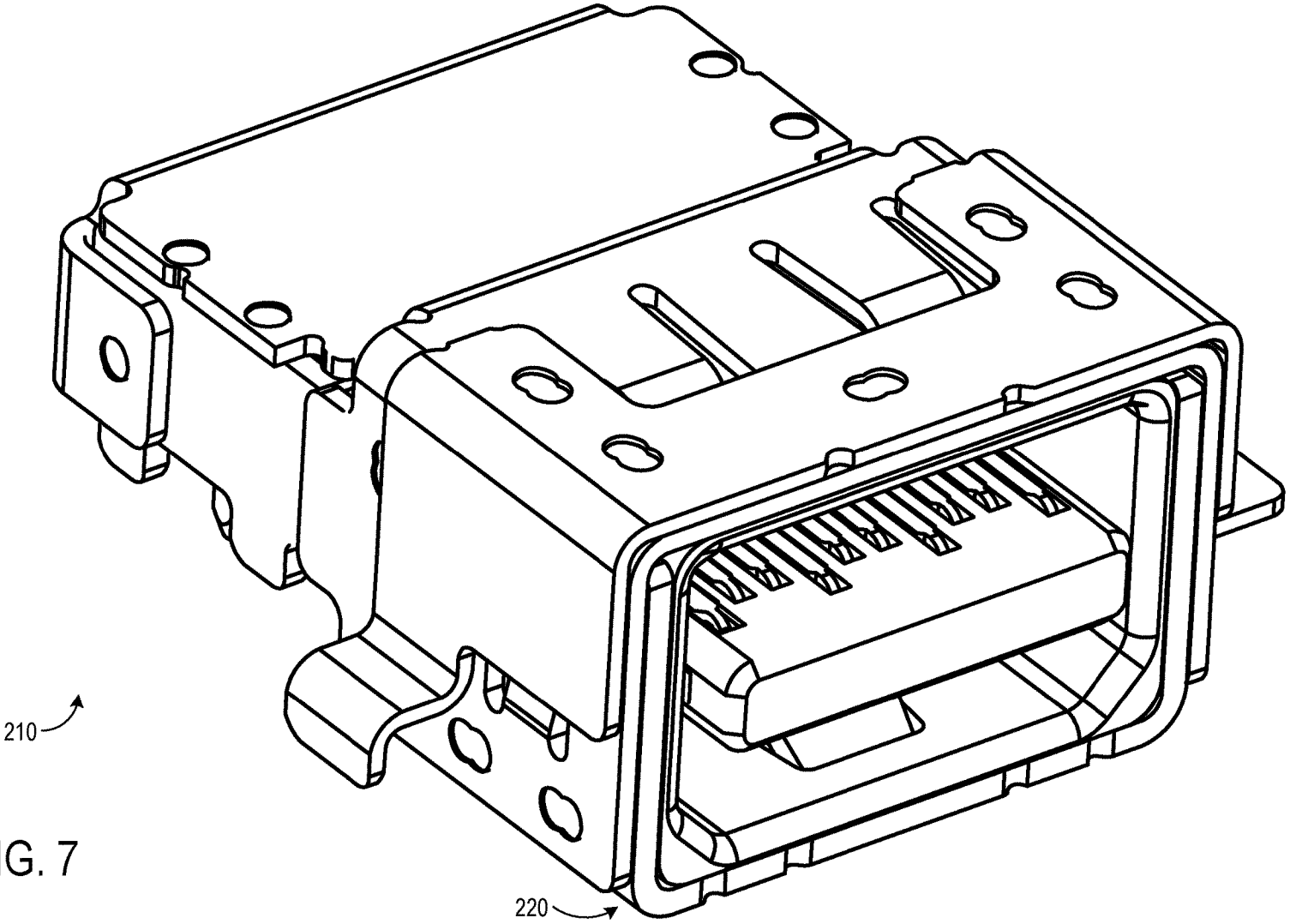
FIG. 7 shows a perspective view of a third type of interconnect receptacle.
Figure 8:
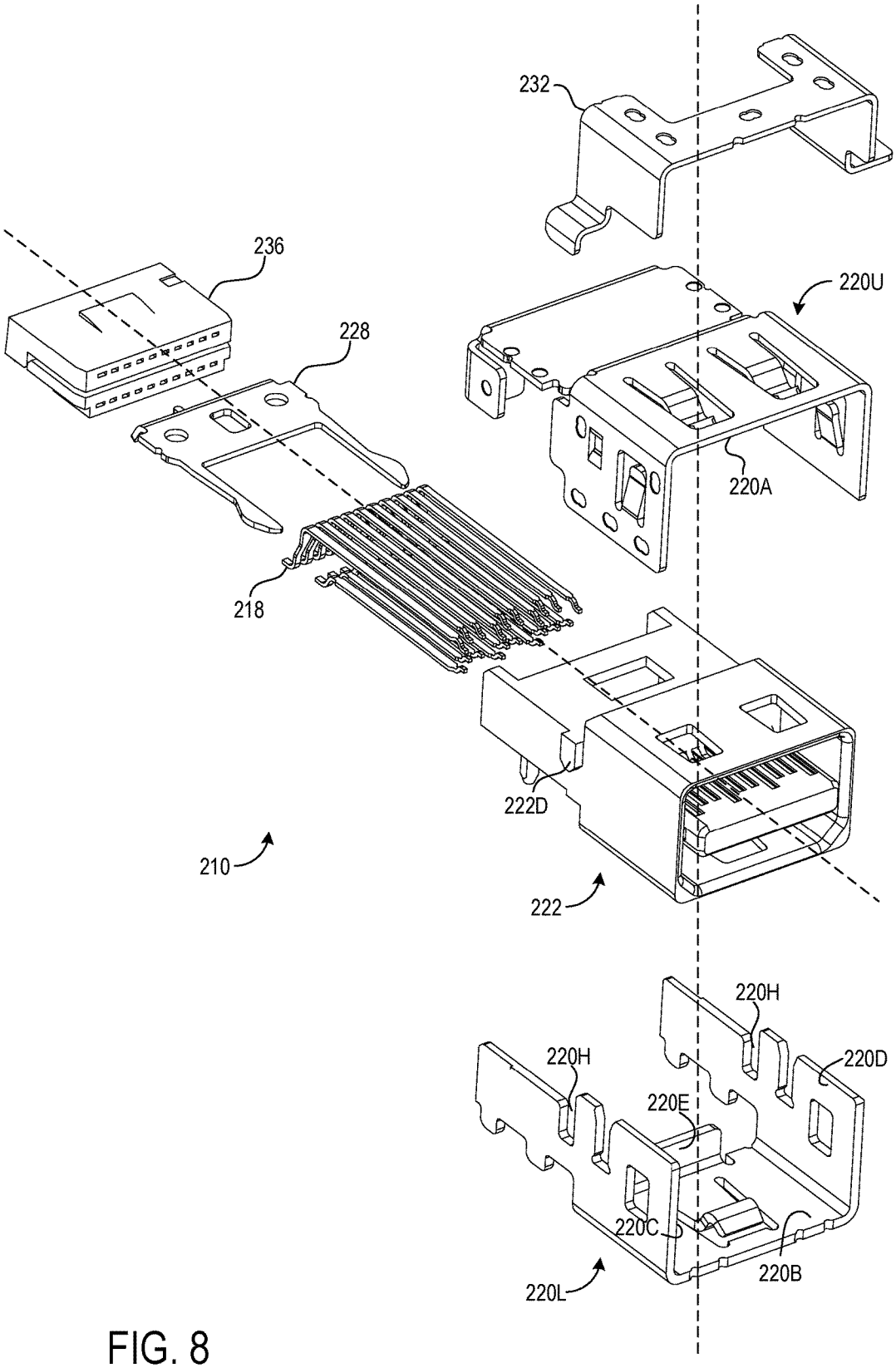
FIG. 8 shows an exploded view of the third type of interconnect receptacle.

FIG. 7 shows a perspective view of a third type of interconnect receptacle. In this example, an interconnect receptacle 210 is depicted as a MINI DISPLAYPORT receptacle, also referred to as an MDP connector, and therefore may be compliant with a DISPLAYPORT specification such as DISPLAYPORT 1.1a, 1.2, 1.2a, 1.3, and/or 1.4 and MINI DISPLAYPORT CONNECTOR. FIG. 8 shows an exploded view of the third type of interconnect receptacle. The interconnect receptacle 210 may be configured to receive the plug 12 (see FIG. 2) of a corresponding type therein, which in this example may be an MDP plug shaped to fit the MDP receptacle 210. When corresponding components of the USB-C receptacle 110 or the USB-A receptacle 10 and the MDP receptacle 210 are similar, repeat explanation may be brief or not provided, and differences will mainly be described instead.

The receptacle 210 may also comprise a tongue 216 with pins 218 applied thereon for electrical contact with the plug. The receptacle 210 may further include a metal shell 220 (see FIG. 7) comprising a plurality of inner walls, e.g., inner walls 220A-220D, configured to surround at least a portion of the tongue 216. The inner walls 220A-220D of the metal shell 220 may include a top 220A, a bottom 220B, and two sides 220C, 220D, and the metal shell 220 may additionally include a rear wall 220E. The metal shell 220 may include joined upper and lower shells 220U, 220L. The receptacle 110 may further include a plastic liner 222 positioned inside the metal shell 220 to cover at least three of the inner walls 220A-220D, in this example, all four. The liner 22 may cover all four inner walls 220A-220D as well as the rear wall 220E at least in part because of the central location of the tongue 216 rendering parts of all five walls easily visible to the user without the liner. While the receptacle 210 may not be reversible like the receptacle 110, the pins 218 may be applied on both the top and bottom of the tongue 216 like the receptacle 110, and therefore space may be provided above and below the tongue 216 for the plug 12 to enter the receptacle 210 and contact the pins 218. Because the rear walls of the receptacle 210 above and below the tongue 216 may be visible to the user, the liner 222 may include a rear wall 222E (see front view shown in FIG. 10C) to cover the rear wall 220E of the shell 220. The receptacle 210 may further include a collar 232 positioned over upper shell 220, a mid-plane ground plate 228, and inserts 236 for the pins 218.

Figure 9:
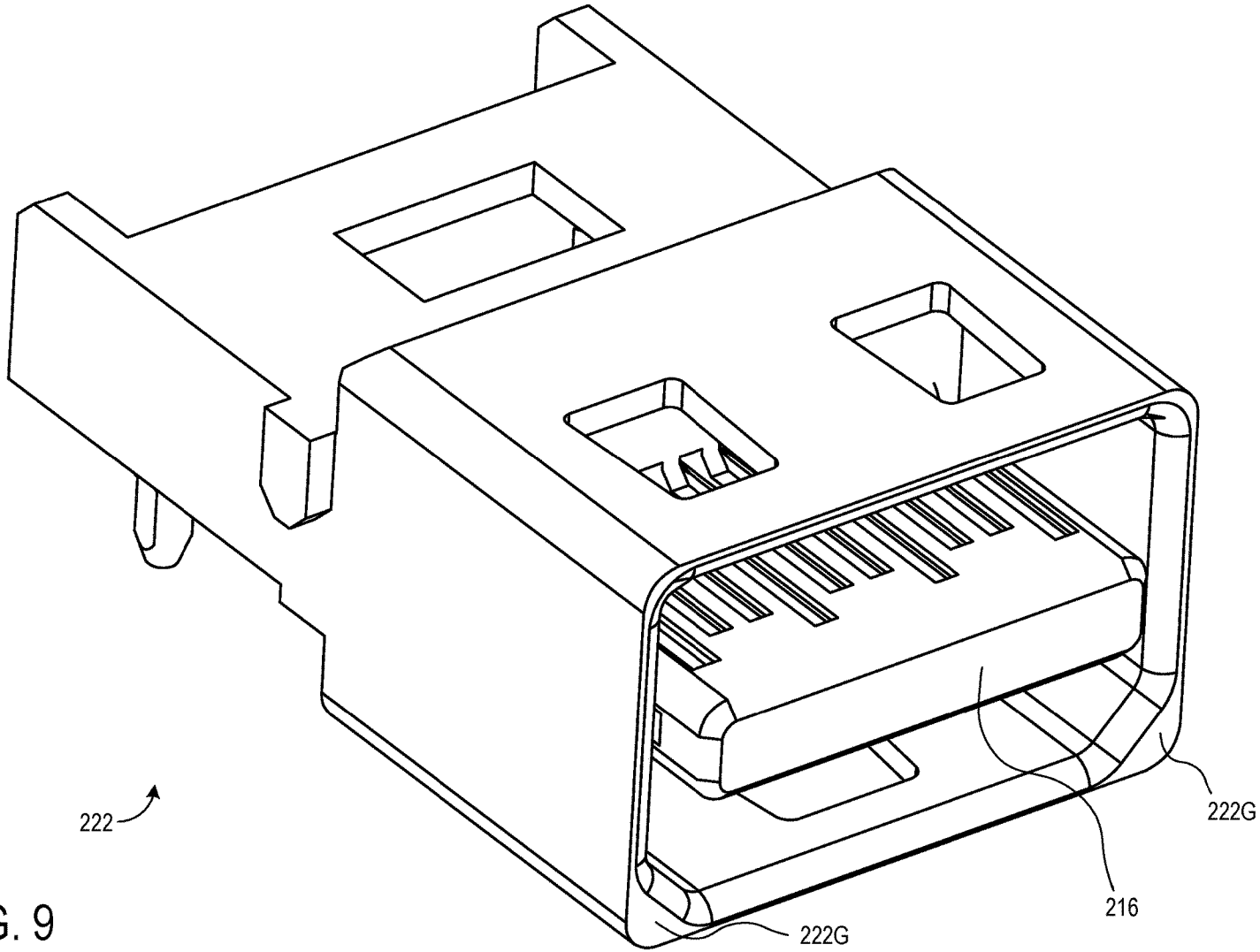
FIG. 9 shows a perspective view of a liner of the third type of interconnect receptacle.

In the MDP receptacle 210, the plastic liner 222 and the tongue 216 may be integrally formed of the same material. An enlarged view of just the liner 222 (with tongue 216) is shown in FIG. 9. As can be seen, bottom corner ridges 222G may be relatively thick compared to the rest of the liner 222. Filling the corners with plastic may allow the entrance of the receptacle 210 to match the shape of an MDP plug while simplifying the manufacturing of the lower shell 220 which is conventionally bent to accomplish the same shape. Furthermore, the thickened ridges 222G lend the liner 222 strength and stability, which allow the thin walls to withstand both the reflow process and general wear and tear during use.

As with the receptacle 10, when manufacturing the receptacle 210, the plastic liner 222 may be injection molded and inserted into the metal shell 220 using interlocking parts. In this case, the liner 222 may include one or more tabs 222D to interlock with one or more slots 22011 formed in the shell 220 as the interlocking parts. The liner 222 may also be formed of a fiber-reinforced plastic including glass fibers. However, while the USB-C receptacle 110 may be configured to run at up to THUNDERBOLT 3 speeds of 40 Gbps and the USB-A receptacle 10 may run at up to around 5 Gbps, the MDP receptacle 210 may be configured to run at up to around 10 Gbps. Therefore, maintaining signal integrity is not as difficult for the MDP receptacle 210 as for the USB-C receptacle 110, and the fiber-reinforced plastic of the receptacle 110 may thus include 10-40% glass fibers to maintain compliance with a DISPLAYPORT specification, with approximately 35% exhibiting better performance.

Figure 10A:
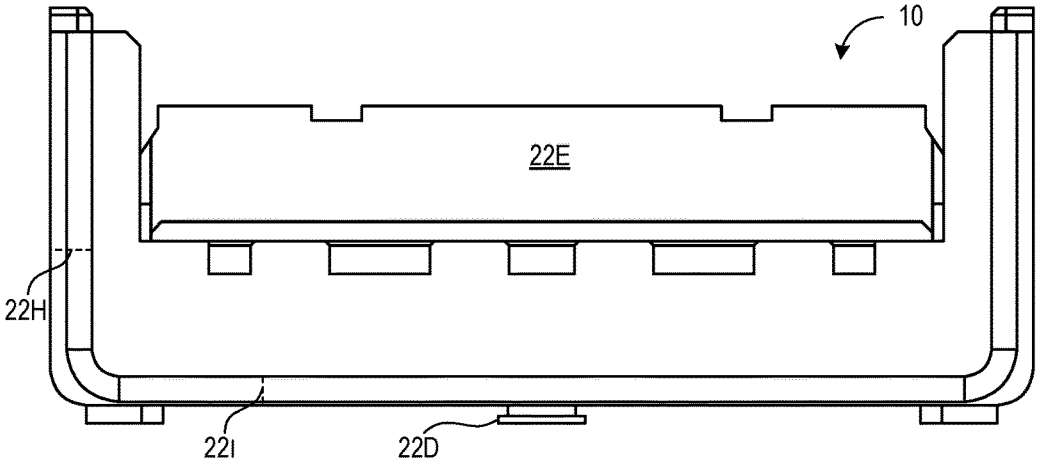
FIGS. 10A-C show front views of the liner of the first, second, and third types of interconnect receptacles, respectively.
Figure 10B:
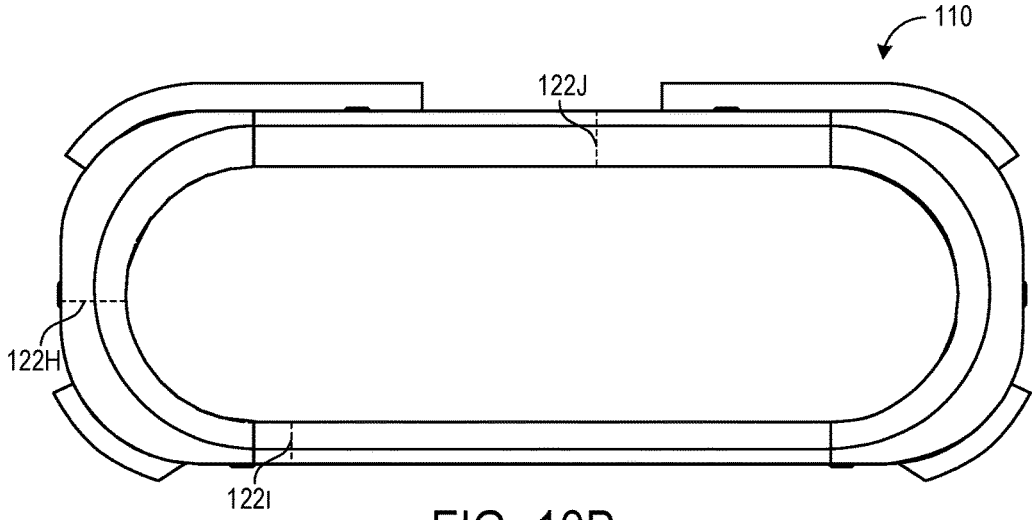
Figure 10C:
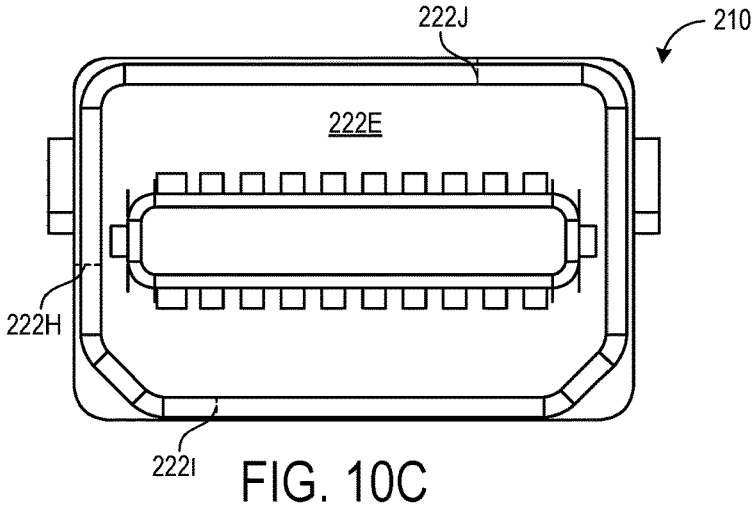

FIGS. 10A-C show front views of the liner of the first, second, and third types of interconnect receptacles, respectively. As can be seen in each of the examples, side walls 22H, 122H of the plastic liner 22, 122 may be thicker than a bottom 22I, 122I of the plastic liner 22, 122. For example, the bottom 22I of the liner 22 may be as thin as 0.3 mm, while the sides 22H may be as thin as 0.5 mm; and the bottom 122I and top 122J of the liner 122 may be as thin as 0.3 mm, while the sides 122H may be as thin as 0.5 mm. However, the bottom 222I, sides 222H, and top 222J of the liner 222 may each be as thin as 0.3 mm. As such, a minimum thickness of the plastic liner may be 0.3 mm to 0.4 mm. These minimum values represent the thinnest the plastic walls can reasonably be made in order to maintain compliance with the corresponding specification (e.g., so that the associated standardized plug 12 can be inserted), maintain signal integrity, maintain structural integrity of the plastic during reflow and typical use over a lifetime of the product, and also sufficiently cover the metal surfaces of the shell from the vantage point of a user looking into the entrance of the receptacle. In addition, the thickness of the plastic liner may be 0.3 mm to 0.8 mm and still demonstrate suitable characteristics. The lower end of the range may be defined by molding and strength limitations, while the upper end may be defined by impact to the overall size of the connector.

Figure 11:
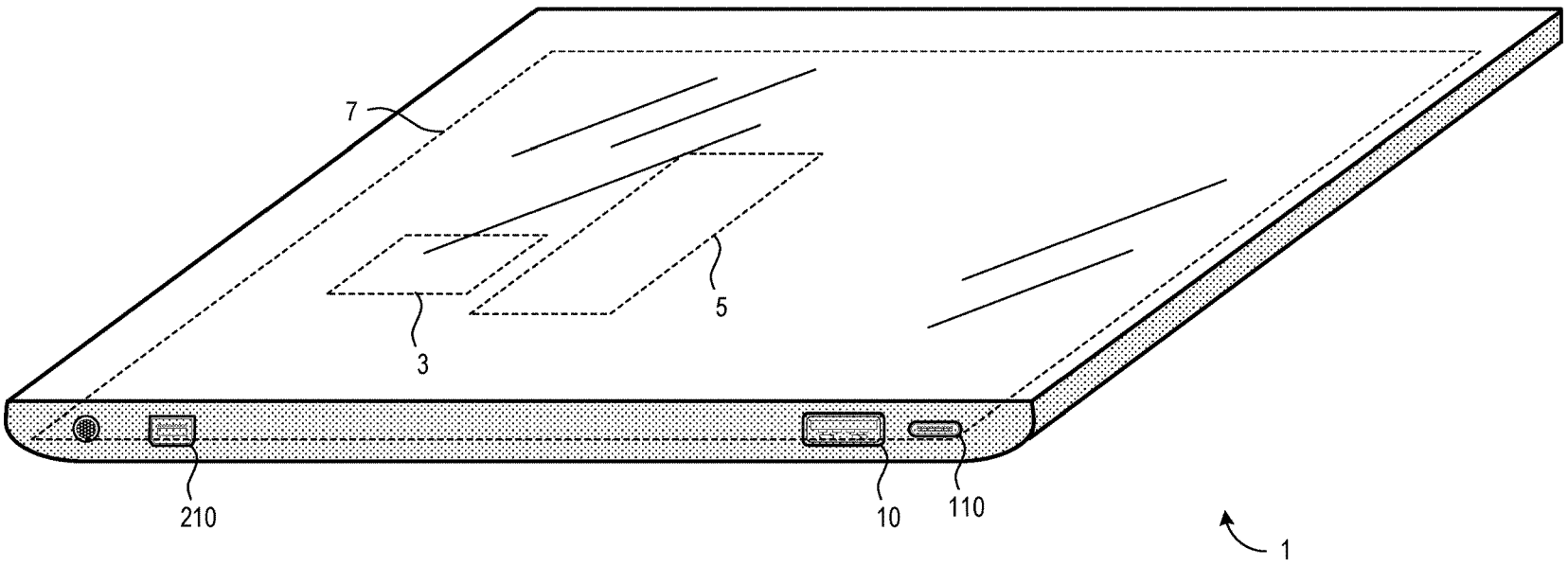
FIG. 11 shows an illustration of a computing device in which interconnect receptacles are installed.

FIG. 11 shows an illustration of a computing device in which interconnect receptacles are installed. The interconnect receptacle 10, 110, 210 may be installed in a computing device 1 and a color of the plastic liner 22, 122, 222 may be an external color of the computing device 1. In this illustration, the computing device 1 may be a tablet; however, the computing device may be a personal computer, server, home-entertainment computer, network computing device, gaming device, mobile computing device, mobile communication device (e.g., smartphone), smart television, and/or other computing device. Although the USB-A receptacle 10, USB-C receptacle 110, and MDP receptacle 210 have been described in detail, the computing device 1 may also have other types of receptacles not explicitly illustrated here, such as HIGH-DEFINITION MULTIMEDIA INTERFACE (HDMI), USB TYPE-B (USB-B), MINI USB, MICRO USB, Ethernet, full-size (i.e., not "mini") DISPLAYPORT, FIREWIRE, etc. Any of these receptacles may include a plastic liner adapted to fit the respective receptacle.

As shown in simplified form using dotted lines, the computing device 1 may comprise a processor 3 configured to execute instructions stored in memory 5. The processor 3 may include one or more central processing unit (CPU) or graphics processing unit (GPU), for example. The memory 5 may include semiconductor memory (e.g., RAM, EPROM, EEPROM, etc.), magnetic memory (e.g., hard-disk drive, MRAM, etc.), volatile, nonvolatile, dynamic, static, read/write, read-only, random-access, sequential-access, location-addressable, file-addressable, and/or content-addressable devices. Alternatively, the processor 3 and memory 5 may be combined into a system-on-a-chip (SOC) or program- and application-specific integrated circuit (PASIC/ASIC) if the computing device 1 uses minimal processing power on its own—for example, the computing device may be an external hard drive or a USB charging hub operated with firmware. The computing device 1 may comprise a printed circuit board 7 operatively connected to the processor 3, and an interconnect receptacle 10 (110, 210), mounted on the printed circuit 7, configured to receive a plug 12 (see FIG. 1) therein. The printed circuit 7 may be a printed circuit board (PCB) such as a motherboard to which the receptacle 10 (110, 210) is directly mounted (e.g., soldered), or it may be a small intervening panel, a peripheral card, a flexible printed circuit (FPC), etc.

As discussed above in greater detail with reference to FIGS. 1-1-9, the interconnect receptacle 10 may comprise a tongue 16 (116, 216) with pins 18A, 18B (118, 218) applied thereon for electrical contact with the plug 12, a metal shell 20 (120, 220) comprising a plurality of inner walls, e.g., inner walls 20A-20D (120A-120D, 220A-220D), configured to surround at least a portion of the tongue 16 (116, 216), and a plastic liner 22 (122, 222) positioned inside the metal shell 20 (120, 220) to cover at least three of the inner walls 20A-20D (120A-120D, 220A-220D). It will be appreciated that while the metal shell 20 (120, 220) is shown here as comprising one or two pieces that form a complete circumference around the tongue 16 (116, 216), these pieces may instead form less than a complete circumference (e.g., comprise fewer than four walls) and the shell may further include other metal components such as a chassis (not illustrated), inner walls of which may also be covered by the liner 22 (122, 222). As such, the inner walls of the shell, including the chassis, may form metal inner walls of the receptacle itself that are covered at least in part by the plastic liner.

The interconnect receptacle 10 (110, 210) may be compliant with a UNIVERSAL SERIAL BUS or DISPLAYPORT specification, among others. Accordingly, a color of the plastic liner 22 (122, 222) may be an external color of the computing device 1, as shown in FIG. 11. In addition, the plastic liner 22 (122, 222) and the tongue 16 (116, 216) may be formed of the same material and also have the same color. The ability to apply the same or coordinating colors and textures to the interior of the receptacle 10 (110, 210) as to the exterior of the computing device 1 may provide a unified and complete cosmetic effect as well as broadening the available color palette from merely metal plating (e.g., silver or black metal) to nearly any color of plastic. In addition, metal plating generally comes at a greater cost than the plastic liner 22 (122, 222), and may degrade the appearance of a receptacle when worn off with use, as well as the electrical performance of the receptacle if the plating has different electrical properties than the material of the metal shell.

Figure 12:
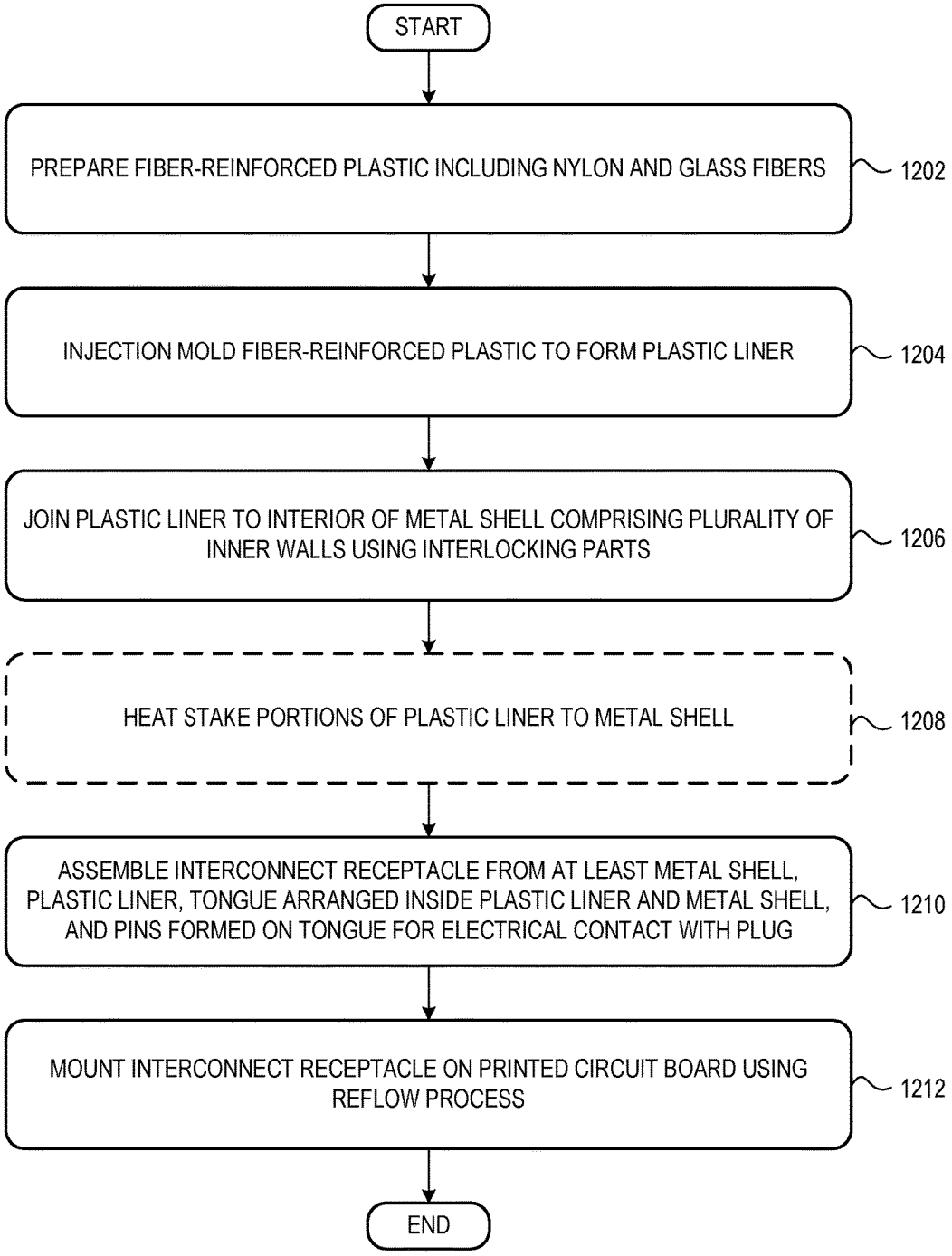
FIG. 12 is a flow chart of a method of manufacturing an interconnect receptacle.

FIG. 12 is a flow chart of a method 1200 of manufacturing an interconnect receptacle configured to receive a plug therein. The following description of method 1200 is provided with reference to the components of the receptacles 10, 110, 210 described above and shown in FIGS. 1-11. It will be appreciated that the method 1200 may also be performed in other contexts using other suitable components according to various interconnect protocols and standards.

With reference to FIG. 12, at 1202 the method 1200 may include preparing a fiber-reinforced plastic including nylon and glass fibers. As discussed above, depending on the balance between signal integrity and structural integrity chosen, the glass fiber fill may be approximately 10-40%. At 1204 the method 1200 may include injection molding the fiber-reinforced plastic to form a plastic liner. At 1206 the method 1200 may include joining the plastic liner to an interior of the metal shell comprising at least four inner walls using interlocking parts, for example, by aligning tabs of the plastic liner with slots of the metal shell. The tabs and slots may be formed to align and hold the liner in place. It will be appreciated that steps 1204 and 1206 may be performed simultaneously by insert molding the plastic directly in the metal shell, using the metal shell as a mold. At 1208 the method 1200 may optionally include heat staking portions of the plastic liner to the metal shell. This pre-reflow process may allow portions of the liner to be held firmly in place so that less bowing of the liner occurs when it is later heated to high temperatures. The heat staked portions may include the tabs of the liner, portions of side walls, or other portions.

At 1210 the method 1200 may include assembling the interconnect receptacle from at least the metal shell, the plastic liner, a tongue arranged inside the plastic liner and the metal shell, and pins formed on the tongue for electrical contact with a plug. As discussed above, depending on the type and configuration of the receptacle, the tongue may be integrally or separately formed with the liner. In addition, the tongue and the liner may be formed of the same material, in the same color. At 1212 the method 1200 may include mounting the interconnect receptacle on a printed circuit such as a PCB or FPC using a reflow process. As discussed above, the reflow process may include heating the receptacle to approximately 200-250° C. for approximately 10 minutes such that the plastic liner may partially soften and reharden when solder melts and reforms to adhere the receptacle to the printed circuit. The printed circuit may be installed in a computing device such as the one shown in FIG. 11. Accordingly, the plastic-lined receptacle and tongue may be the same color as an exterior of the computing device to provide a high-end cosmetic effect in a variety of customizable colors. Furthermore, when made in accordance with the above method 1200, the receptacle may perform on-par with or better than conventional receptacles without a plastic liner, in terms of signal integrity, durability, transfer speed, etc.

The subject matter of the present disclosure is further described in the following paragraphs. One aspect provides an interconnect receptacle configured to receive a plug therein, the interconnect receptacle comprising a tongue with pins applied thereon for electrical contact with the plug, a metal shell comprising a plurality of inner walls configured to surround at least a portion of the tongue, and a plastic liner positioned inside the metal shell to cover at least three of the inner walls. In this aspect, the plastic liner and the tongue may be integrally formed of the same material. In this aspect, the plastic liner and the tongue may be separately formed of the same material of the same color. In this aspect, the plurality of inner walls of the metal shell may include a top, a bottom, and two sides, and the plastic liner may cover the two sides and at least one of the top and the bottom. In this aspect, the plastic liner may be injection molded and inserted into the metal shell. In this aspect, the plastic liner may be formed of a material including nylon. In this aspect, the plastic liner may be formed of a fiber-reinforced plastic including glass fibers. In this aspect, the fiber-reinforced plastic may include 10-40% glass fibers. In this aspect, the interconnect receptacle may be compliant with a UNIVERSAL SERIAL BUS specification. In this aspect, the interconnect receptacle may be compliant with a DISPLAYPORT specification. In this aspect, the metal shell may include joined upper and lower shells. In this aspect, a thickness of the plastic liner may be 0.3-0.8 mm. In this aspect, the interconnect receptacle may be installed in a computing device and a color of the plastic liner may be an external color of the computing device. In this aspect, the plastic liner may extend a full length of an interior of the metal shell. In this aspect, side walls of the plastic liner may be thicker than a bottom of the plastic liner.

According to another aspect, a computing device is provided. The computing device may comprise a processor configured to execute instructions stored in memory, a printed circuit operatively connected to the processor, and an interconnect receptacle, mounted on the printed circuit, configured to receive a plug therein. The interconnect receptacle may comprise a tongue with pins applied thereon for electrical contact with the plug, a metal shell comprising a plurality of inner walls configured to surround at least a portion of the tongue, and a plastic liner positioned inside the metal shell to cover at least three of the inner walls. In this aspect, a color of the plastic liner may be an external color of the computing device. In this aspect, the interconnect receptacle may be compliant with a UNIVERSAL SERIAL BUS or DISPLAYPORT specification. In this aspect, the plastic liner and the tongue may be formed of the same material.

According to another aspect, a method of manufacturing an interconnect receptacle configured to receive a plug therein is provided. The method may comprise preparing a fiber-reinforced plastic including nylon and glass fibers, injection molding the fiber-reinforced plastic to form a plastic liner, joining the plastic liner to an interior of a metal shell comprising a plurality of inner walls using interlocking parts, assembling the interconnect receptacle from at least the metal shell, the plastic liner, a tongue arranged inside the plastic liner and the metal shell, and pins formed on the tongue for electrical contact with a plug, and mounting the interconnect receptacle on a printed circuit using a reflow process.

It will be understood that the configurations and/or approaches described herein are exemplary in nature, and that these specific embodiments or examples are not to be considered in a limiting sense, because numerous variations are possible. The specific method described herein may represent one or more of any number of strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, devices, and configurations, and other features, functions, acts, and/or properties disclosed herein, as well as any and all equivalents thereof.

The invention claimed is:

1. An interconnect receptacle configured to receive a plug through an opening therein, comprising:

a tongue with pins applied thereon for electrical contact with the plug;

a metal shell comprising a plurality of inner walls configured to surround at least a portion of the tongue; and a plastic liner positioned inside the metal shell to cover substantially all externally visible portions of at least three of the inner walls adjacent the opening, wherein the plastic liner has one or more trapezoid cutouts that accommodate corresponding features of one or more of the plurality of inner walls of the metal shell, the one or more trapezoid cutouts are positioned in a top or bottom of the plastic liner, each trapezoid cutout is defined by four sides, with a first side being a narrowest side, the first side is parallel to a third side of the trapezoid cutout, and a second side and a fourth side of the trapezoid cutout are non-parallel, and the first side is positioned proximate a front edge of the plastic liner and is parallel with the front edge of the plastic liner.

2. The interconnect receptacle of claim 1, wherein the plastic liner and the tongue are integrally formed of the same material.

3. The interconnect receptacle of claim 1, wherein the plastic liner and the tongue are separately formed of the same material of the same color.

4. The interconnect receptacle of claim 1, wherein the plurality of inner walls of the metal shell include a top, a bottom, and two sides, and the plastic liner covers the two sides and at least one of the top and the bottom.

5. The interconnect receptacle of claim 1, wherein the plastic liner is injection molded and inserted into the metal shell.

6. The interconnect receptacle of claim 1, wherein the plastic liner is formed of a fiber-reinforced plastic including glass fibers.

7. The interconnect receptacle of claim 1, being compliant with a UNIVERSAL SERIAL BUS specification.

8. The interconnect receptacle of claim 1, being compliant with a DISPLAYPORT specification.

9. The interconnect receptacle of claim 1, wherein the metal shell includes joined upper and lower shells.

10. The interconnect receptacle of claim 1, wherein a thickness of the plastic liner is 0.3-0.8 mm.

11. The interconnect receptacle of claim 1, wherein the interconnect receptacle is installed in a computing device and a color of the plastic liner is the same as an external color of the computing device.

12. The interconnect receptacle of claim 1, wherein the plastic liner extends a full length of an interior of the metal shell.

13. The interconnect receptacle of claim 1, wherein side walls of the plastic liner are thicker than a bottom of the plastic liner.

14. The interconnect receptacle of claim 1, wherein:

the metal shell has one or more partial-trapezoid cutouts that overlap with the trapezoid cutouts of the plastic liner; and the features of the metal shell include springs formed from the partial-trapezoid cutouts.

15. The interconnect receptacle of claim 1, wherein the plastic liner is formed of a material including nylon.

16. The interconnect receptacle of claim 15, wherein the fiber-reinforced plastic includes 10-40% glass fibers.

17. A computing device, comprising:

a processor configured to execute instructions stored in memory;

a printed circuit operatively connected to the processor; and an interconnect receptacle, mounted on the printed circuit, configured to receive a plug through an opening therein, the interconnect receptacle comprising:

a tongue with pins applied thereon for electrical contact with the plug;

a metal shell comprising a plurality of inner walls configured to surround at least a portion of the tongue; and a plastic liner positioned inside the metal shell to cover substantially all externally visible portions of at least three of the inner walls adjacent the opening, wherein the plastic liner has one or more trapezoid cutouts that accommodate corresponding features of one or more of the plurality of inner walls of the metal shell, the one or more trapezoid cutouts are positioned in a top or bottom of the plastic liner, each trapezoid cutout is defined by four sides, with a first side being a narrowest side, the first side is parallel to a third side of the trapezoid cutout, and a second side and fourth side of the trapezoid cutout are non-parallel, and the first side is positioned proximate a front edge of the plastic liner and is parallel with the front edge of the plastic liner.

18. The computing device of claim 17, wherein a color of the plastic liner is the same as an external color of the computing device.

19. The computing device of claim 17, wherein the interconnect receptacle is compliant with a UNIVERSAL SERIAL BUS or DISPLAYPORT specification.

20. The computing device of claim 17, wherein the plastic liner and the tongue are formed of the same material.

21. A method of manufacturing an interconnect receptacle configured to receive a plug through an opening therein, comprising:

preparing a fiber-reinforced plastic including nylon and glass fibers;

injection molding the fiber-reinforced plastic to form a plastic liner, wherein the plastic liner is formed to have one or more trapezoid cutouts positioned in a top or bottom of the plastic liner, each trapezoid cutout being defined by four sides, with a first side being the narrowest side, the first side is parallel to a third side of the trapezoid cutout, a second side and fourth side of the trapezoid cutout are non-parallel, and the first side is positioned proximate a front edge of the plastic liner and is parallel with the front edge of the plastic liner;

joining the plastic liner to an interior of a metal shell comprising a plurality of inner walls using interlocking parts such that the plastic liner covers substantially all externally visible portions of at least three of the inner walls adjacent the opening, wherein the one or more trapezoid cutouts in the plastic liner accommodate corresponding features of one or more of the plurality of inner walls of the metal shell;

assembling the interconnect receptacle from at least the metal shell, the plastic liner, a tongue arranged inside the plastic liner and the metal shell, and pins formed on the tongue for electrical contact with a plug; and mounting the interconnect receptacle on a printed circuit using a reflow process.

* * * * *